US007890321B2

(12) United States Patent
Ichikawa

(10) Patent No.: US 7,890,321 B2
(45) Date of Patent: Feb. 15, 2011

(54) NOISE REDUCTION DEVICE, PROGRAM AND METHOD

(75) Inventor: Osamu Ichikawa, Ebina (JP)

(73) Assignee: International Business Machines Corporation, Armonk, NY (US)

( * ) Notice: Subject to any disclaimer, the term of this patent is extended or adjusted under 35 U.S.C. 154(b) by 119 days.

(21) Appl. No.: 12/185,954

(22) Filed: Aug. 5, 2008

(65) Prior Publication Data

US 2008/0294430 A1 Nov. 27, 2008

(30) Foreign Application Priority Data

Dec. 10, 2004 (JP) ..... 2004-357821

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS 5,608,804 A * 3/1997 Hirano ..... 381/71.12
6,212,273 B1 * 4/2001 Hemkumar et al. .... 379/406.08
7,003,099 B1 * 2/2006 Zhang et al. ..... 379/406.03
2004/0083107 A1 * 4/2004 Noda et al. ..... 704/270
2006/0198538 A1 * 9/2006 Malvar et al. ..... 381/95

FOREIGN PATENT DOCUMENTS

JP 09-307625 5/1999

* cited by examiner

*Primary Examiner*—Jakieda R Jackson
(74) *Attorney, Agent, or Firm*—Michael J. Buchenhorner; Vazken Alexanian

(57) ABSTRACT

A noise reduction device is configured by use of: means for calculating a predetermined constant, and a predetermined reference signal Rω(T) in the frequency domain, respectively by use of adaptive coefficients Wω(m), and for thereby obtaining estimated values Nω and Qω(T) respectively of stationary noise components, and non-stationary noise components corresponding to the reference signal, which are included in a predetermined observed signal Xω(T) in the frequency domain; means and for applying a noise reduction process to the observed signal on the basis of each of the estimated values, and for updating each of the adaptive coefficients on the basis of a result of the process; and an adaptive learning means and for repeating the obtaining of the estimated values and the updating of the adaptive coefficients, and for thereby learning each of the adaptive coefficients.

20 Claims, 10 Drawing Sheets

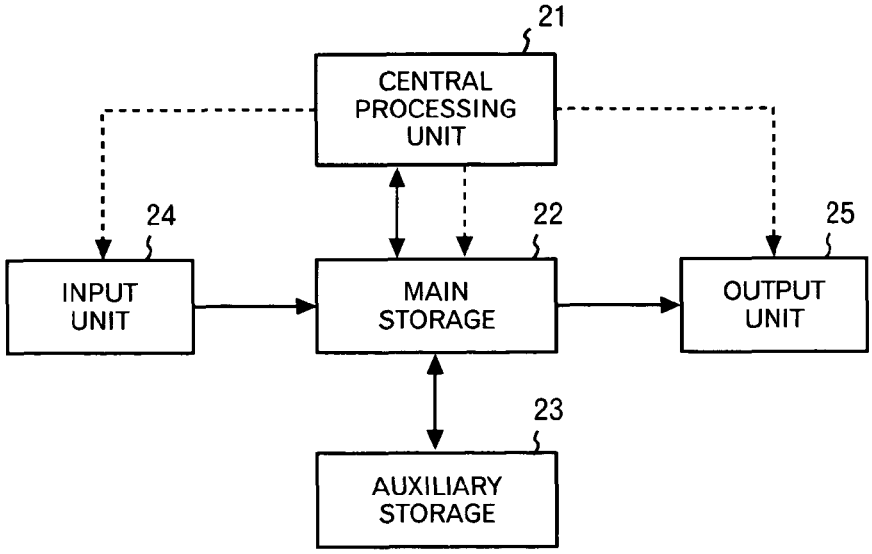

FIG. 2

| LADDER | TARGETTED NOISE |
|---|---|
| LADDER 1 | STATIONARY DRIVING NOISE |
| LADDER 2 | STATIONARY DRIVING NOISE + SOUND FROM CD/RADIO |
| LADDER 3 | STATIONARY DRIVING NOISE + NON-STATIONARY ENVIRONMENT NOISE (ROAD BUMPS, PASSING CARS, WIPER, etc.) |
| LADDER 4 | STATIONARY DRIVING NOISE + NON-STATIONARY ENVIRONMENT NOISE + SOUND FROM CD/RADIO |
| LADDER 5 | STATIONARY DRIVING NOISE + NON-STATIONARY ENVIRONMENT NOISE + SOUND FROM CD/RADIO + SPEECH OF PASSENGER |

FIG. 11

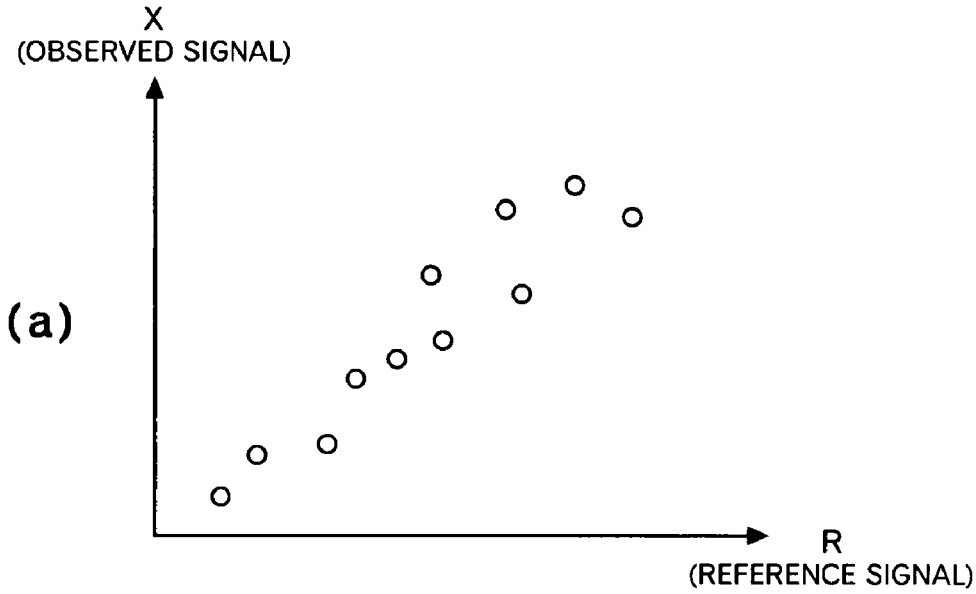
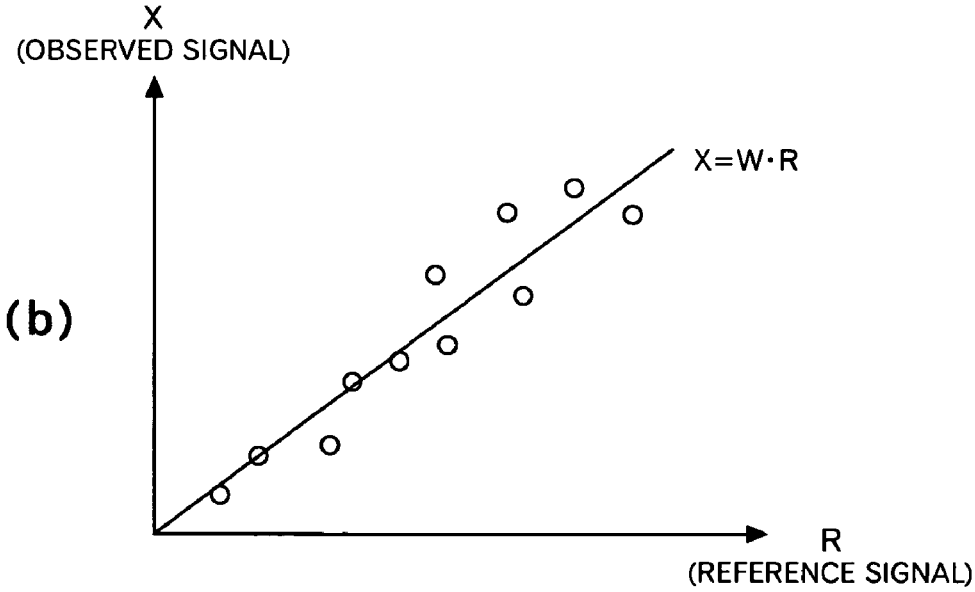
FIG. 3

TABLE 2

| | NOISE REDUCTION METHOD | BLOCK DIAGRAM SHOWING METHOD |
|---|---|---|
| EXAMPLE 1 | METHOD OF FIRST EMBODIMENT ($L=5$, $\alpha_1=1.0$, $\alpha_2=2.0$) | R, X, NR (SS), EC IN SS MODE, Y, X-N'', X-N''-WR, SIMULTANEOUS ESTIMATION (N'', W) |
| EXAMPLE 2 | METHOD OF SECOND EMBODIMENT ($L=5$, $\alpha_1=1.0$, $\alpha_2=2.0$) | R, EC IN TIME DOMAIN, X, NR (SS), EC IN SS MODE, Y, X-N'', X-N''-WR, SIMULTANEOUS ESTIMATION (N'', W) |
| COMPARATIVE EXAMPLE 1 | SS ONLY (IN CASE OF NO MUSICAL SOUND) | NR (SS) |
| COMPARATIVE EXAMPLE 2 | SS ONLY | NR (SS) |
| COMPARATIVE EXAMPLE 3 | EC + SS | EC IN TIME DOMAIN, NR (SS) |
| COMPARATIVE EXAMPLE 4 | EC IN SS + SS MODE | X, NR (SS), X-N', EC IN SS MODE, Y, X-N'-WR |
| COMPARATIVE EXAMPLE 5 | EC AS PRE-PROCESS + SS + EC IN SS MODE | EC IN TIME DOMAIN, NR (SS), EC IN SS MODE |

FIG. 7

TABLE 3 RATE (%) OF ERROR IN WORDS IN DIGIT TASK

| | 0[km] | 50[km] | 100[km] | AVERAGE |
|---|---|---|---|---|
| EXAMPLE 1 | 1.3 | 2.3 | 2.4 | 2.0 |
| EXAMPLE 2 | 1.3 | 1.3 | 2.1 | 1.6 |
| COMPARATIVE EXAMPLE 1 | 0.5 | 0.6 | 1.1 | 0.8 |
| COMPARATIVE EXAMPLE 2 | 2.8 | 14.1 | 13.1 | 10.0 |
| COMPARATIVE EXAMPLE 3 | 1.8 | 3.2 | 3.6 | 2.8 |
| COMPARATIVE EXAMPLE 4 | 1.8 | 9.4 | 8.9 | 6.7 |
| COMPARATIVE EXAMPLE 5 | 1.7 | 2.4 | 3.3 | 2.5 |

FIG. 8

TABLE 4 RATE(%) OF ERROR IN WORDS IN COMMAND TASK

| | 0[km] | 50[km] | 100[km] | AVERAGE |
|---|---|---|---|---|
| EXAMPLE 1 | 3.2 | 2.9 | 3.9 | 3.3 |
| EXAMPLE 2 | 2.6 | 2.9 | 2.2 | 2.6 |
| COMPARATIVE EXAMPLE 1 | 2.6 | 1.0 | 3.5 | 2.4 |
| COMPARATIVE EXAMPLE 2 | 3.5 | 15.1 | 13.1 | 10.6 |
| COMPARATIVE EXAMPLE 3 | 4.2 | 3.5 | 6.1 | 4.6 |
| COMPARATIVE EXAMPLE 4 | 3.8 | 10.9 | 11.2 | 8.7 |
| COMPARATIVE EXAMPLE 5 | 3.5 | 3.9 | 4.8 | 4.1 |

FIG. 9

NOISE REDUCTION DEVICE, PROGRAM AND METHOD

FIELD OF THE INVENTION

The present invention relates to a noise reduction device, a noise reduction program and a noise reduction method, all of which make it possible to adaptively learn each of adaptive coefficients used respectively for obtaining estimated values of stationary noise and non-stationary noise at the same time, to thereby improve an effect of noise suppression, and to thus enhance speech adequate for speech recognition in an environment where both the stationary noise and the non-stationary noise are present.

BACKGROUND OF THE INVENTION

First of all, descriptions will be provided for the current status of an in-vehicle speech recognition system which constitutes the background of the present invention. The in-vehicle speech recognition system has reached a level of practical use where the in-vehicle speech recognition system is applied mainly to the inputting of commands, addresses and the like in a car navigation system. In reality, however, CD music needs to be stopped from being played, or passengers need to refrain from talking, while speech recognition is being performed. In addition, speech recognition can not be performed in a case where a crossing bell is being sounding in a nearby railroad crossing. Consequently, reviewing the present level of development of the in-vehicle speech recognition, one may think that many restraints have still been imposed on use of the in-vehicle speech recognition system, and that the in-vehicle speech recognition system is still technically in a transition period.

One may think that noise robustness in the in-vehicle speech recognition system will be achieved step by step through its technological development ladder 1 to 5 as shown in FIG. 11. In other words, in its development ladder 1, what the in-vehicle speech recognition system is robust against is only stationary driving noise. In its development ladder 2, what the in-vehicle speech recognition system is robust against will be noise in which the stationary driving noise as well as speeches and sounds coming from a CD player or a radio (hereinafter referred to as a "CD/radio") are mixed with each other. In its development ladder 3, what the in-vehicle speech recognition system is robust against will be noise in which the stationary driving noise and non-stationary environment noise are mixed each other. The non-stationary environment noise includes noise which is made while the car runs on a bumpy road, noise which is made by other cars passing by the car, noise which is made by the windshield wipers in operation, and the like. In its development ladder 4, what the in-vehicle speech recognition system is robust against will be noise in which the stationary driving noise, the non-stationary environment noise and the sounds coming from the CD/radio are mixed with one another. In its development ladder 5, the stationary driving noise, the non-stationary environment noise, the sounds coming from the CD/radio, and speeches uttered by passengers are mixed with one another. The current technological level is at its development ladder 1. Intensive studies are being carried out in order to make the technological level reach its development ladders 2 and 3.

In the case of its development ladder 1, a multi-style training technique and a spectral subtraction technique have made great contributions to enhancing the noise robustness. The multi-style training technique is a technique for using sound, in which various noises are superimposed on speeches uttered by humans, for the adaptive learning of an acoustic model. In addition, stationary noise components are subtracted from an observed signal by use of the spectral subtraction technique, both when speech recognition is performed and when an acoustic model is adaptively trained. These techniques have remarkably enhanced noise robustness. As a consequence, the speech recognition system has reached the level of practical use as far as the stationary cruising noise is concerned.

The sounds coming from the CD/radio to be treated in its development ladder 2 are non-stationary noise as in the case of the non-stationary environment noise to be treated in its development ladder 3. However, the sounds coming from the CD/radio is different from the non-stationary environment noise in that the sounds coming from the CD/radio are sounds coming from specific in-vehicle appliances. For this reason, electric signals which have not yet been converted to the sounds can be used, as reference signals, in order to suppress noise. A system for suppressing noise by use of electric signals is termed as an echo canceller. It is known that the echo canceller exhibits high performance in a silent environment where no noise exists except for sounds from the CD/radio. For this reason, it is expected that both the echo canceller and the spectral subtraction technique are used in the development ladder 2 of the in-vehicle speech recognition system. It is known, however, that performance of a conventional echo canceller is degraded in a vehicle compartment of a car which is moving. This is because noise, including driving noise irrelevant to reference signals, is observed at the same time as the reference signals are observed.

FIG. 12 is a block diagram showing a configuration of a conventional noise reduction device using only a conventional echo canceller. In general, what is termed as an echo canceller means an echo canceller 40 implemented in the time domain. At this point, suppose that neither speech s uttered by a speaker nor background noise n exists for convenience of explanation. Let r and x respectively denote a sound signal of the CD/radio 2 to be inputted to a loudspeaker 3 and an echo signal to be received by a microphone 1. By use of an impulse response g in the vehicle compartment, the sound signal and the echo signal are related to each other as follows $$x=r*g$$

where * denotes a convolution calculation.

In this respect, the echo canceller 40 can cancel the echo signal x through the following process. An estimated value h of the impulse response g is figured out in an adaptive filter 42. Thus, an estimated echo signal r*h is generated. In a subtraction unit 43, the estimated echo signal r*h is subtracted from a signal In of sound received by the microphone 1. Thereby, the echo signal x can be cancelled. In general, a filter coefficient h is learned in a non-speech segment by use of a least-mean-square (LMS) algorithm or a normalized least-mean-square (N-LMS) algorithm. The echo canceller takes both a phase and an amplitude into consideration. For this reason, it can be expected that the echo canceller brings about a higher performance as far as a silent environment is concerned. It is known, however, that the performance decreases when environment noise around the echo canceller is high.

FIG. 13 is a block diagram showing a configuration of another conventional noise reduction device, which includes an echo canceller 40 in its front stage and a noise reduction unit 50 in its rear stage. The noise reduction unit 50 reduces stationary noise. Here is used the noise reduction unit using a spectral subtraction technique. This device exhibits a higher performance than the device using only the echo canceller and the device using only the spectral subtraction technique. However, an input In into the echo canceller 40 in the front stage includes stationary noise to be reduced in the rear stage. This brings about a problem which decreases performance of the echo cancellation (for example, see Basbug, F., Swaminathan, K., and Nandkumar, S. [2000]. "Integrated Noise Reduction and Echo Cancellation For IS-136 Systems," *Proceedings of ICASSP*, vol. 3, pp. 1863-1866, which will be hereinafter referred to "Non-patent Literature 1).

As measures to increase performance of the echo canceller in a noisy environment, one may conceive that noise reduction is performed before noise cancellation is performed. In theory, however, the noise reduction using the spectral subtraction technique can not be performed before the echo canceller is implemented in the time domain. In addition, if noise reduction is designed to be performed by use of a filter, the echo canceller can not follow change in the filter. Furthermore, if the noise reduction is performed before the noise cancellation is performed, this brings about a problem that echo components obstructs the estimating of stationary noise components for the purpose of the noise reduction. For this reason, there have been a small number of cases where the noise reduction is performed before the echo cancellation is performed.

FIG. 14 is a block diagram showing one of such cases. A noise reduction device of this type includes: a noise reduction unit 60 for performing noise reduction by means of performing spectral subtraction in its front stage; and an echo canceller 70 in its rear stage. Noise reduction is attempted both in the stage prior to, and in the stage posterior to, the echo canceller, in the case of the noise reduction device including this configuration disclosed in Ayad, B., Faucon, G., and B-Jeannes, R. L. [1996]. "Optimization of a Noise Reduction Preprocessing in an Acoustic Echo and Noise Controller," *Proceedings of ICASSP*, vol. 2. However, the noise reduction to be performed in the stage prior to the echo canceller holds a mere pre-processing function.

If an echo canceller using the spectral subtraction technique or a Wiener filter in the frequency domain is adopted as the echo canceller 70 in the rear stage, the noise reduction can be performed before the echo cancellation is performed, or at the same time as the echo cancellation is performed. In this case, however, echo components are included in noise components to be reduced, in the noise reduction unit 60. This makes it difficult to estimate stationary noise components exactly. With this difficulty into consideration, an application of the noise reduction device disclosed in Non-patent Literature 1 is limited to talks on the phone. The noise reduction device disclosed in Non-patent Literature 1 is designed to measure stationary noise components during a time when the two calling parties utter no speech, or during a time when only background noise exists.

FIG. 15 shows an example of yet another conventional noise reduction device. This example is a noise reduction device which is realized by further providing the noise reduction device of FIG. 14 with the echo canceller 40 in the time domain in the stage prior to the noise reduction unit 60 for the purpose of estimating the stationary noise components more exactly. Accordingly, this noise reduction device is designed to reduce echo components beforehand (for example, see Dreiseitel, P., and Puder, H. [1997]. "A Combination of Noise Reduction and Improved Echo Cancellation," *Conference Proceedings of IWAENC*, London, 1997, pp. 180-183 (which will be hereinafter referred to as "Non-patent Literature 3), and Sakauchi, S., Nakagawa, A., Haneda, Y., and Kataoka, A. [2003]. "Implementing and Evaluating an Audio Teleconferencing Terminal with Noise and Echo Reduction," *Conference Proceedings of IWAENC, Japan,* 2003, pp. 191-194 (which will be hereinafter referred to as "Non-patent Literature 4)). In this case, even if the pre-processing is performed by use of the echo canceller 40, some echo components still remain. However, what the noise reduction device is applied to is hands-free talks. This makes it possible to expect that a time occurs during which the two calling parties utter no speech, or during which only background noise exists. For this reason, stationary noise components may be measured more exactly during the time when the two calling parties utter no speech, or during the time when only background noise exists.

In the case of these conventional noise reduction devices, the respective echo cancellers are constituted in a two-stage manner. These constitutions make it possible to reduce echo more securely. In the case of each of the noise reduction devices disclosed in Non-patent Literatures 3 and 4, echo components which are as large as designated by an estimate value of the echo are reduced as they are. For this reason, the echo components can not be eliminated completely. In addition, in the case of the noise reduction device disclosed in Non-patent Literature 3, flooring is performed on the basis of a value of output from the preprocessing. In the case of the noise reduction device disclosed in Non-patent Literature 4, an original sound adding method for improving audibility is adopted. In each of the two cases, echo elements can not be reduced to zero. On the other hand, in a case where residual noise is in the form of music or spoken news, no matter how much the power of the residual noise may be weakened, it is likely that the noise is treated as human speeches, and that this treatment leads to a false recognition, when speech recognition is intended to be performed.

Non-patent Literature 4 also refers to a scheme for dealing with reverberation of echo. According to this scheme, while an echo cancellation process is being performed, an estimated value of echo, which has been found in a previous frame, is multiplied by a coefficient, and a value thus obtained is added to an estimated value of echo in the current frame. Thereby, the echo cancellation process is performed on both echo components and reverberation components. However, this brings about a problem that the coefficient needs to be given corresponding to an environment in a room in advance, and that the coefficient is not determined automatically.

An echo canceller using a power spectrum in the frequency domain can deal with not only a case where echo and reference signals to be referred to in order to reduce the echo are in the form of monophonic signals, but also a case where they are in the form of stereo signals. Specifically, a power spectrum of a reference signal may be defined as a weighted average of the right and left reference signals, and the weight may be determined in accordance with a degree of a correlation among the observed signal as well as its right and left reference signals, as described in Deligne, S., and Gopinath, R. [2001]. "Robust Speech Recognition with Multi-channel Codebook Dependent Cepstral Normalization (MCDCN)," *Conference Proceedings of ASRU,* 2001, pp. 151-154. In a case where a pre-process is intended to be performed for an echo canceller in the time domain, a stereo echo canceller technique, on which many research results have been disclosed, may be applied to the pre-process.

SUMMARY OF THE INVENTION

Thus, an aspect of the present invention is to provide a noise reduction technique which makes it possible to improve noise robustness in an environment where non-stationary noise, such as sounds coming from the CD/radio, exists in addition to stationary noise. The aspect is achieved by effective use of existing acoustic models and the like, without changing the framework of the spectral subtraction technique described above to a large extent.

Another aspect of the present invention is to provide a noise reduction technique which makes it possible to estimate stationary noise components even in conditions where echo sound always exists.

Another aspect of the present invention is to provide a noise reduction technique which makes it possible to more fully reduce echo components which are the chief cause of a source error in recognized characters. The aspect can be achieved by means of maintaining compatibility between the noise reduction technique and the acoustic model when stationary noise is intended to be reduced.

In another aspect of the present invention, an observed signal can be obtained by converting the sound wave to an electric signal and by thereafter converting the electric signal to a signal in the frequency domain.

In still another aspect of the present invention, an observed signal and a reference signal can be obtained by converting a signal in the time domain to a signal in the frequency domain in each predetermined frame.

In the case of yet another aspect of the present invention, each of the adaptive coefficients to be obtained by the learning is used in a noise segment where the observed signal does not include non-stationary noise components.

BRIEF DESCRIPTION OF THE DRAWINGS

For a more complete understanding of the present invention and the advantages thereof, reference is now made to the following description taken in conjunction with the accompanying drawings, in which:

FIG. 2 is a block diagram showing a computer constituting the system shown in FIG. 1;

FIGS. 3(*a*) and 3(*b*) are diagram respectively showing how the system shown in FIG. 1 enables estimate stationary noise components N to be estimated as the same time as an adaptive coefficient W concerning a reference signal R is estimated;

FIG. 7 is a diagram represented as Table 2 showing noise reduction methods to be used respectively in examples and comparative examples as well as block diagrams illustrating the methods;

FIG. 8 is a diagram represented as Table 3 showing results of performing speech recognition by means of a digit task with regard to each of the examples and the comparative examples;

FIG. 9 is a diagram represented as Table 4 showing results of performing speech recognition by means of a command task with regard to each of the examples and the comparative examples;

FIG. 11 is a diagram represented as Table 11 showing steps of development of noise robustness in an in-vehicle speech recognition system;

DETAILED DESCRIPTION OF THE INVENTION

As described above, the spectral subtraction technique is widely used in a speech recognition process nowadays. With this taken into consideration, the present invention provides a noise reduction technique which makes it possible to improve noise robustness in an environment where non-stationary noise, such as sounds coming from the CD/radio, exists in addition to stationary noise. This is achieved by effective use of existing acoustic models and the like, without changing the framework of the spectral subtraction technique to a large extent.

Figure 14:
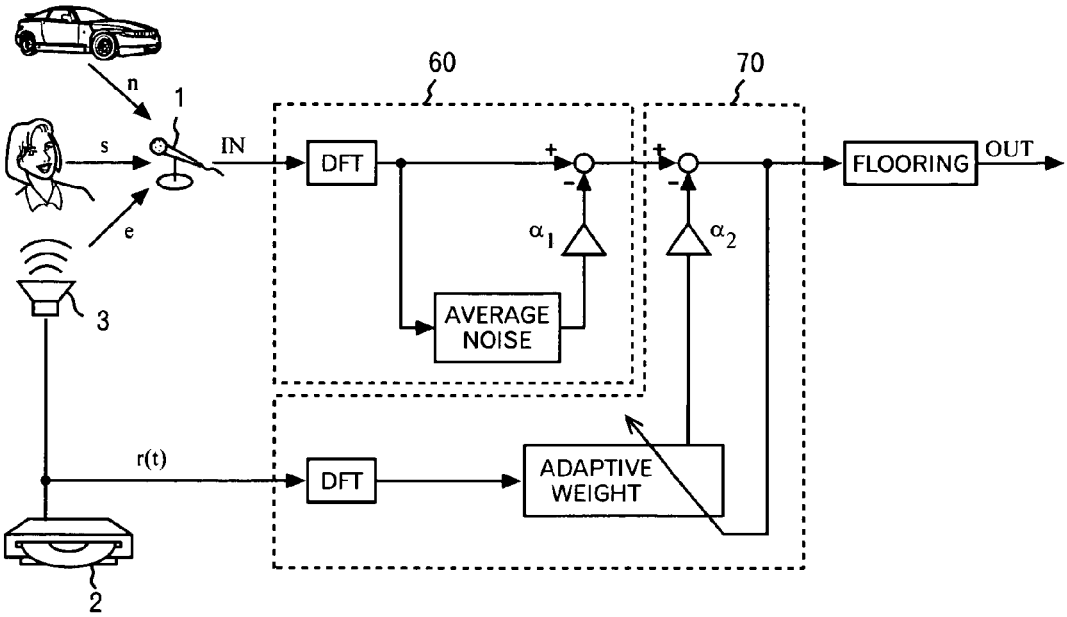
FIG. 14 is a block diagram showing yet another conventional noise reduction device which includes a noise reduction unit for performing noise reduction by means of performing spectral subtraction in its front stage and an echo canceller in its rear stage.
Figure 15:
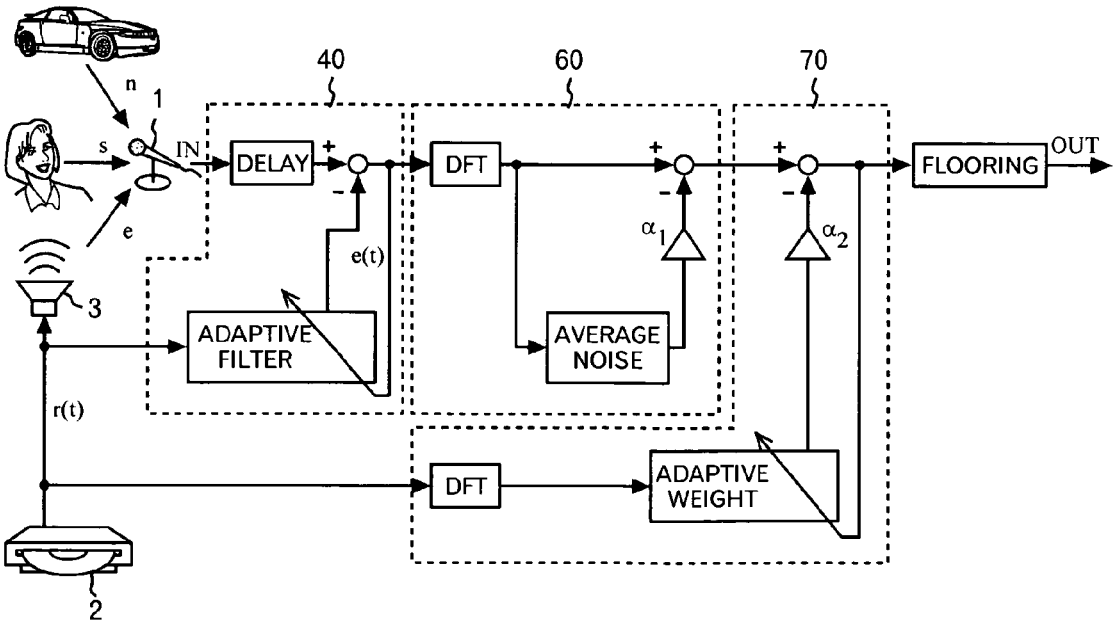
FIG. 15 is a block diagram showing still another conventional noise reduction device provided with an echo canceller in the time domain in the front stage of the device shown in FIG. 14.

In addition, in a case where sounds coming from the in-vehicle CD/radio are a sound source of echo, it can not be expected that a time during which no echo exists occurs. For this reason, stationary noise components can not be estimated exactly by use of the conventional techniques as shown in FIGS. 14 and 15, which techniques are based on an assumption that a time during which only stationary noise exists occurs. With this taken into consideration, the present invention provides a noise reduction technique which makes it possible to estimate stationary noise components even in conditions where echo sound always exists.

Moreover, the conventional technique as shown in FIG. 15 can further improve performance of reducing echo components. However, in a case where the conventional technique is applied to a speech recognition process, it is likely that the conventional technique may falsely recognize slight residual echo components as speech uttered by humans. With this problem taken into consideration, yet the present invention provides a noise reduction technique which makes it possible to more fully reduce echo components which are the chief cause of a source error in recognized characters. This is achieved by means of maintaining compatibility between the noise reduction technique and the acoustic model when stationary noise is intended to be reduced.

Furthermore, in the case of the aforementioned scheme for dealing with reverberation of echo, a coefficient by which to multiply an estimated value of the echo which has been figured out in the previous frame needs to be given corresponding to an environment of a room in advance. This brings about a problem that the coefficient can not be determined automatically. Accordingly, still the present invention provides a noise reduction technique which makes it possible to reduce the reverberation of the echo while learning the coefficient whenever necessary.

In the case of a noise reduction device, a noise reduction program and a noise reduction method, a predetermined constant is calculated by use of its adaptive coefficient, and a predetermined reference signal in the frequency domain is calculated by use of its adaptive coefficient. Thereby, estimated values are obtained respectively for stationary noise components included in a predetermined observed signal in the frequency domain and non-stationary noise components corresponding to the reference signal. Subsequently, a noise reduction process is applied to the observed signal on the basis of each of the estimated values. Based on the results, each of the adaptive coefficients is updated. Each of the adaptive coefficients is learned by means of obtaining the estimated values and updating the adaptive coefficients in a repetitive manner.

In this respect, the noise reduction device, the noise reduction program and the noise reduction method are, for example, what is used for a speech recognition system and a hands-free telephone. The noise reduction process is, for example, that which uses the spectral subtraction technique or the Wiener filter.

In the case of this configuration, when the estimated values respectively of the stationary noise components and the non-stationary noise components included in the observed signal are obtained, the noise reduction process is applied to the observed signal on the basis of each of the estimated values. Based on this result, each of the adaptive coefficients is updated. Based on each of the adaptive coefficients thus updated, each of the estimated values is figured out once again. Each of the adaptive coefficients is learned through repeating this learning step. In other words, each time the learning step is performed, both of the adaptive coefficients are sequentially updated on the basis of a result of performing the noise reduction process by use of the estimated values respectively of the stationary noise and the non-stationary noise. Simultaneously, both of the adaptive coefficients are learned. If the noise reduction process is applied to the observed signal on the basis of the estimated values to be obtained by means of applying the respective adaptive coefficients which are finally obtained through this learning process, the stationary noise components and the non-stationary noise components can be reduced from the observed signal in a satisfactory manner.

In the case of the present invention, the adaptive coefficients respectively of the stationary noise components and the non-stationary noise components are designed to be learned at the same time. For this reason, the noise reduction process can be performed more exactly in comparison with a conventional scheme. In the case of the conventional scheme, a noise reduction process is performed on the basis of a result of learning components of one of the stationary noise and the non-stationary noise. Thereafter, with regard to the observed signal to which the noise reduction process has thus been applied, components of the other of the stationary noise and the non-stationary noise are learned separately. Thus, a result of this learning is reflected on the noise reduction process at high exactness.

In a case of the present invention, an observed signal is obtained by converting the sound wave to an electric signal and by thereafter converting the electric signal to a signal in the frequency domain. In addition, a reference signal can be obtained by converting, to a signal in the frequency domain, a signal corresponding to sound coming from a sound source of non-stationary noise which is a cause of non-stationary noise components included in the observed signal. A sound wave is converted to an electric signal, for example, by use of a microphone. An electric signal is converted to a signal in the frequency domain, for example, by use of the discrete Fourier transform (DFT). A sound source of non-stationary noise includes, for example, a CD player, a radio, a machine which produces non-stationary operating sound and a speaker of a telephone. A signal corresponding to sound coming from a sound source of non-stationary noise includes, for example, a speech signal which is in the form of an electric signal generated in a sound source of non-stationary noise, and what is in the form of an electric signal converted from sound coming from a sound source of non-stationary noise.

In this case, before the electric signal is converted to a signal in the frequency domain, an echo cancellation in the time domain may be applied to the electric signal on the basis of the reference signal which has not yet been converted to a signal in the frequency domain.

In another case of the present invention, an observed signal and a reference signal is obtained by converting a signal in the time domain to a signal in the frequency domain in each predetermined frame. In this case, estimated values respectively of non-stationary noise components in each predetermined frame is obtained on the basis of reference signals in a plurality of predetermined frames preceding the frame. In addition, a coefficient for the reference signal is any one of a plurality of coefficients respectively for the reference signals in the plurality of predetermined frames.

In this case, a noise reduction process is performed by means of subtracting, from the observed signal, estimated values respectively of the stationary noise components and the non-stationary noise components. In addition, the learning is performed by means of updating the adaptive coefficients in a way that makes smaller a mean-square value of the difference between the observed signal and a sum of the estimated values respectively of the stationary noise components and the non-stationary noise components in each predetermined frame.

In another case of the present invention, each of the adaptive coefficients to be obtained by the learning is used in a noise segment where the observed signal does not include non-stationary noise components. In addition, the estimated values respectively of stationary noise components and non-stationary noise components included in the observed signal are obtained on the basis of the reference signal in a non-noise segment where the observed signal includes the non-stationary noise components. Thereby, a noise reduction process is applied to the observed signal on the basis of each of the estimated values. In this case, if the non-stationary components are based on speech uttered by a speaker, an output as a result of the noise reduction process is used for a speech recognition process to be applied to the speech uttered by the speaker.

In this case, the noise reduction process is performed by means of subtracting, from the observed signal, the estimated values respectively of the stationary noise components and the non-stationary noise components. In this respect, before the subtraction process is performed, the estimated values respectively of the stationary noise components may be multiplied by a first subtraction coefficient. As a value of the first subtraction coefficient, a value which is equivalent to that taken on by a subtraction coefficient to be used for reducing stationary noise components by means of the spectral subtraction technique when the acoustic model to be used for the speech recognition is learned. The "equivalent value" includes not only a "value equal" to that taken on by the subtraction coefficient but also a value in a range in which expected effects of the present invention is obtained. Furthermore, in this case, before the subtraction process is performed, the estimated values respectively of the non-stationary noise components may be multiplied by a second subtraction coefficient. To this end, a value larger than that taken on by the first subtraction coefficient may be used as a value taken on by the second subtraction coefficient.

Figure 1:
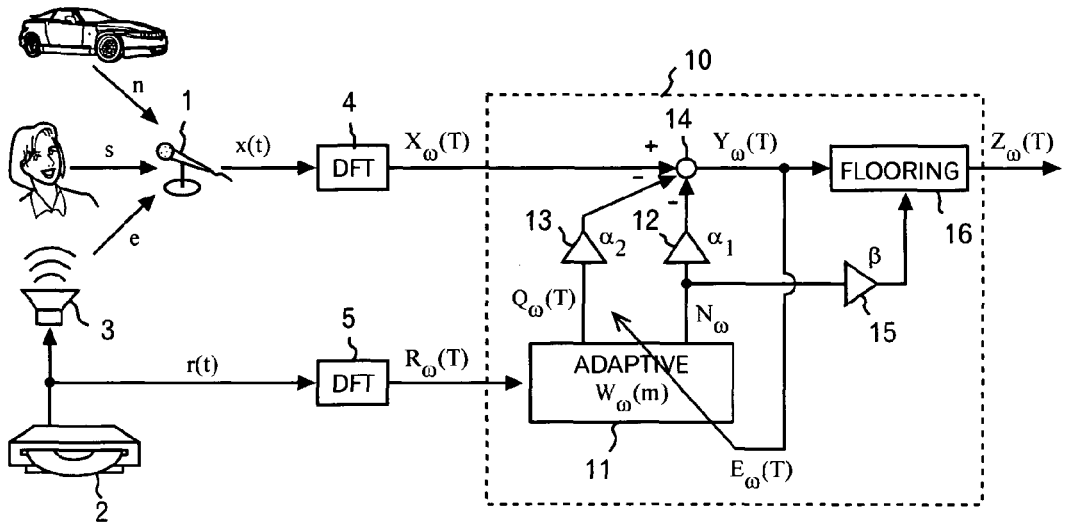
FIG. 1 is a block diagram showing a configuration of a noise reduction system according to an embodiment of the present invention.

FIG. 1 is a block diagram showing a configuration of a noise reduction system according to an embodiment of the present invention. As shown in FIG. 1, this system includes a microphone 1, a discrete Fourier transform unit 4, a discrete Fourier transform unit 5 and a noise reduction unit 10. The microphone 1 converts sound from the surroundings to an observed signal x(t) which is in the form of an electric signal. The discrete Fourier transform unit 4 converts the observed signal x(t) to an observed signal Xω(T) which is in the form of the power spectrum in each of predetermined sound frames. The discrete Fourier transform unit 5 receives, as a reference signal r(t), an output signal from an in-vehicle CD/radio 2 to a speaker 3, and thus converts the reference signal to a reference signal Rω(T) which is in the form of a power spectrum in each of the sound frames. The noise reduction unit 10 makes reference to the reference signal Rω(T), thereby performing an echo cancellation process and reducing stationary noise with regard to the observed signal Xω(T). In this case, T denotes a number representing each of the sound frames, and corresponds to the time. ω denotes a bin number in the Fourier transform (DFT), and corresponds to the frequency. The observed signal Xω(T) can include components of stationary noise n from passing vehicles and the like, speech s uttered by a speaker, and echo e from the speaker 3. The noise reduction unit 10 performs a process for each bin number.

The noise reduction unit 10 reduces stationary noise by use of the echo canceller and the spectral subtraction technique integrally. In other words, the noise reduction unit 10 obtains, through the adaptive learning, an adaptive coefficient Wω(m) to be used for calculating an estimated value Qω(T) of the power spectrum in echo included in the observed signal Xω(T), in a non-speech segment where no speech exists. During the process, the noise reduction unit 10 figures out an estimated value Nω of the power spectrum of the stationary noise included in the observed signal Xω(T). On the basis of a result of this, the noise reduction unit 10 performs the echo cancellation process, and reduces the stationary noise, in a speech segment where speech s exists.

The noise reduction unit 10 includes an adaptation unit 11, multiplication units 12 and 13, a subtraction unit 14, a multiplication unit 15, and a flooring unit 16. The adaptation unit 11 calculates the estimated values Qω(T) and Nω on the basis of the adaptive coefficient Wω(m). The multiplication unit 12 multiplies the estimated value Nω by a subtraction weight $\alpha_1$. The multiplication unit 13 multiplies the estimated value Qω(T) by a subtraction weight 2. The subtraction unit 14 subtracts outputs of the multiplication units 12 and 13 from the observed signal Xω(T) and outputs a result Yω(T) of the subtraction. The multiplication unit 15 multiplies the estimated value Nω by a flooring coefficient β. The flooring unit 16 outputs a power spectrum Zω(T) which is used when a speech recognition process is applied to the speech s. When a adaptive learning is performed in the non-speech segment, the adaptation unit 11 makes reference to the reference signal Rω(T) in each sound frame, and hence updates the adaptive coefficient Wω(m) by means of using an output Yω(T) from the subtraction unit 14 as an error signal Eω(T). On the basis of the adaptive coefficient Wω(m), the adaptation unit 11 calculates the estimated values Nω and Qω(T). In addition, when the adaptive learning is performed in the speech segment, the adaptation unit 11 calculates the estimated value Qω(T), and outputs the estimated value Nω, on the basis of the reference signal Rω(T) and the adaptive coefficient Wω(m) on which the learning has been performed.

FIG. 2 is a block diagram showing a computer constituting the discrete Fourier transform unit 4 and 5 as well as the noise reduction unit 10. This computer includes a central processing unit 21, a main storage 22, an auxiliary storage 23, an input unit 24, an output unit 25 and the like. The central processing unit 21 processes data, and controls each of the other units, on the basis of programs. The main storage 22 stores a program, which the central processing unit 21 is executing, and relevant data in a way that the program and the relevant data are accessed at a high speed. The auxiliary storage 23 stores the programs and the data. The input unit 24 receives data and an instruction. The output unit 25 outputs a result of a process to be performed by the central processing unit 21, and performs a GUI function in corporation with the input unit 24. In FIG. 2, solid lines show flows of the data, and broken lines show flows of control signals. A noise reduction program to cause the computer to function as the discrete Fourier transform units 4 and 5 as well as the noise reduction unit 10 is installed in this computer. In addition, the input unit 24 includes the microphone 1 shown in FIG. 1 and the like.

The subtraction weights $\alpha_1$ and $\alpha_2$ by which the estimated values Nω and Qω(T) are multiplied respectively in the multiplication units 12 and 13 shown in FIG. 1 are set at "1" when the adaptive coefficient Wω(m) is learned. The subtraction weights $\alpha_1$ and $\alpha_2$ are set at the respective predetermined values when the power spectrum Zω(T) to be used for a speech recognition process is outputted. The error signal Eω(T) to be used for the adaptive learning is expressed by the following equation by use of the observed signal Xω(T), the estimated value Qω(T) of the echo and the estimated value Nω of the stationary noise.

$$E\omega(T)=X\omega(T)-Q\omega(T)-N\omega \tag{1}$$

The estimated value Qω(T) of the echo is expressed by the following equation by use of the reference signal Rω(T−m) representing the previous M−1 frames and the adaptive coefficient Wω(m).

$$Q\omega(T)=\sum_{m=0}^{M-1} W\omega(m)\cdot R\omega(T-m) \tag{2}$$

The reason why the reference signal Rω(T−m) representing the previous M−1 frames is referred to is that a reverberation whose length exceeds one frame is intended to be dealt with. The estimate value Nω of the stationary noise is defined by Equation (3) for reasons of convenience.

$$W\omega(M)=N\omega/\mathrm{Const} \tag{3}$$

On the basis of the definitions respectively of Equations (2) and (3), Equation (1) can be expressed by Equation (4).

$$E\omega(T)=X\omega(T)-[R\omega(T),\ \ldots\ R\omega(T-M+1),\ Const]\cdot\begin{bmatrix} W\omega(0) \\ \vdots \\ W\omega(M-1) \\ W\omega(M) \end{bmatrix} \tag{4}$$

The adaptive coefficient Wω(m) can be figured out through the adaptive learning in a way that minimizes Equation (5) in the non-speech segment.

$$\Phi\omega = \text{Expect}\lfloor\{E\omega(T)\}^2\rfloor \tag{5}$$

where Expect ⌊ ⌋ denotes a manipulation of an expected value.

A manipulation for calculating an average of the frames in the non-speech segment is performed as the manipulation of the expected value. In this respect, a total sum of frames up to the Tth frame in the non-speech segment is expressed by the following symbol.

$$\sum_T$$

When Equation (5) is minimized, the following equation can be established.

$$\frac{\partial \Phi_\omega}{\partial W_\omega(m)} = 0$$

Consequently, the following relationships can be obtained.

$$C\omega = A\omega \cdot B\omega \tag{6}$$

$$A\omega = \begin{bmatrix} \sum_T R\omega(T)\cdot R\omega(T) & \dots & \sum_T R\omega(T-M-1)\cdot R\omega(T) & \sum_T Const\cdot R\omega(T) \\ \vdots & \ddots & \vdots & \vdots \\ \sum_T R\omega(T)\cdot R\omega(T-M+1) & \dots & \sum_T R\omega(T-M+1)\cdot R\omega(T-M+1) & \sum_T Const\cdot R\omega(T-M+1) \\ \sum_T R\omega(T)\cdot Const & \dots & \sum_T R\omega(T-M+1)\cdot Const & \sum_T Const\cdot Const \end{bmatrix} \tag{7}$$

$$B\omega = \begin{bmatrix} W\omega(0) \\ \vdots \\ W\omega(M-1) \\ W\omega(M) \end{bmatrix} \tag{8}$$

$$C\omega = \begin{bmatrix} \sum_T R\omega(T)\cdot X\omega(T) \\ \vdots \\ \sum_T R\omega(T-M+1)\cdot X\omega(T) \\ \sum_T Const\cdot X\omega(T) \end{bmatrix} \tag{9}$$

Consequently, the adaptive coefficient Wω(m) can be figured out by use of the following equation.

$$B\omega = A\omega^{-1}\cdot C\omega \tag{10}$$

If the aforementioned method is performed, an inverse matrix of the matrix Aω needs to be found. For this reason, an amount of the calculation is relatively large. If an approximation for a diagonalization is applied to the matrix Aω, an approximate value of Wω(m) can be also figured out sequentially as follows.

$$\Delta W\omega(m) = A_{LMS}\cdot\frac{R\omega(T-m)\cdot E\omega(T)}{\sum_T R\omega(T-m)\cdot R\omega(T-m) + B_{LMS}} \quad (m < M) \tag{11a}$$

$$\Delta W\omega(m) = A_{LMS}\cdot\frac{Const\cdot E\omega(T)}{\sum_T Const\cdot Const + B_{LMS}} \quad (m = M) \tag{11b}$$

where ΔWω denotes an amount of the updating of Wω(m) in the frame T, $A_{LMS}$ denotes an update coefficient, and $B_{LAM}$ denotes a constant for stability.

In the non-speech segment, the power spectrum Yω(T) as the consequence of reducing the stationary noise and the echo from the observed signal Xω(T) can be obtained by use of W(m) to be found in the non-speech segment in the aforementioned manner. In the speech segment, the power spectrum Yω(T) can be obtained in accordance with Equation (12), or Equation (13) which is obtained by applying Equations (2) and (3) to Equation (12).

$$Y\omega(T) = X\omega(T) - \alpha_2\cdot Q\omega(T) - \alpha_1\cdot N\omega \tag{12}$$

$$Y\omega(T) = X\omega(T) - \alpha_2\cdot\sum_{m=0}^{M-1} W\omega(m)\cdot R\omega(T-m) - \alpha_1\cdot W\omega(M)\cdot Const \tag{13}$$

The acoustic model to be used for a speech recognition process has been heretofore learned with only stationary noise taken into consideration. For this reason, the acoustic model can be applied to the speech recognition process to be performed on the basis of the output Zω(T) in this system, if a value equal to that of the subtraction weight in the spectral subtraction to be applied when the acoustic model is learned is used as a value of the subtraction weight $\alpha_1$ to be assigned to the estimated value Nω of the stationary noise. The application of the acoustic model to the speech recognition process makes it possible to tune, to the best extent possible, performance of the speech recognition to be performed in a case where no echo exists. If a value larger than $\alpha_1$ is used as a value of the subtraction weight $\alpha_2$ to be assigned to the estimated value Nω of the echo, this use makes it possible to more fully reduce echo which is not included when the acoustic model is learned. This makes it possible to remarkably enhance performance of the speech recognition to be performed in a case where the echo exists.

In general, in a case where the spectral subtraction technique is applied to the noise reduction process to be performed as the pre-process for the speech recognition process, adequate flooring is essentially required to be performed. This flooring can be performed, by use of the estimated value Nω of the stationary noise, in accordance with Equations (14a) and (14b), where β denotes the flooring coefficient. If a value equal to that of the flooring coefficient to be used for the noise reduction process which is performed when the acoustic model to be used for the speech recognition to be performed on the basis of the output Zω(T) in this system is used as a value of β, this makes it possible to enhance exactness of the speech recognition process.

$$Z\omega(T)=Y\omega(T) \text{ if } Y(T)\geqq\beta\cdot N\omega \tag{14a}$$

$$Z\omega(T)=\beta\cdot N\omega \text{ if } Y\omega(T)<\beta\cdot N\omega \tag{14b}$$

Through this flooring, the power spectrum Zω(T) which is inputted into the speech recognition, and which is the consequence of reducing the stationary noise and the echo, can be obtained. If the inverse discrete Fourier transform (I-DFT) is applied to Zω(T), and concurrently if a phase of the observed signal is used, speech z(t) in the time domain which is actually audible to the human ears can be obtained.

FIGS. 3(*a*), 3(*b*), 4(*a*) and 4(*b*) show how the addition of the constant term Const to Equation (4) representing the error signal Eω(T) to be used for the adaptive learning enables the stationary noise components to be estimated at the same time as an adaptive coefficient W concerning the reference signal R is estimated. Incidentally, the figures show it in a case where a value representing the number M of frames in the reference signal R to be used for calculating the estimated value of the echo components is defined as "1" for reasons of simplification. FIG. 3(*a*) is a graph which plots an association between an observed value of the power of the reference signal R and a corresponding observed value of the power of the observed signal X in each of the frames to be observed in the non-speech segment in a case where a source of the echo exists, and concurrently in a case where no background noise as the stationary noise exists. In FIG. 3(B), relationships of the observed signals X with the reference signals R which are obtained by applying the adaptive coefficients W representing the respective adaptations to be estimated on these observed values are expressed by a plane curve expressed by X=W·R.

Figure 4:
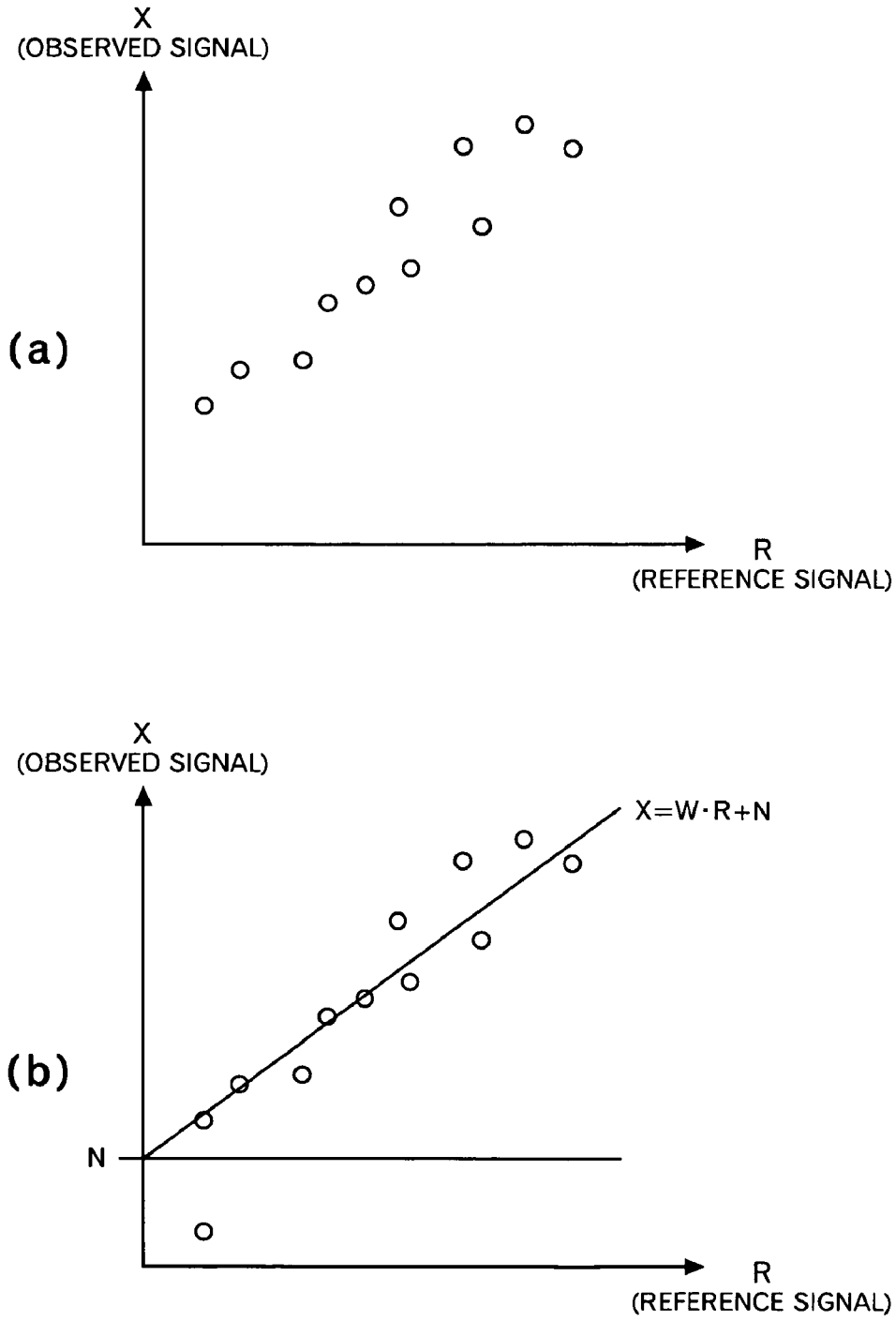
FIGS. 4(*a*) and 4(*b*) are diagrams respectively showing, in cooperation with FIGS. 3(*a*) and 3(*b*), how the system shown in FIG. 1 enables the estimate stationary noise components N to be estimated as the same time as the adaptive coefficient W concerning the reference signal R is estimated.

On the other hand, FIG. 4(*a*) is a graph which plots an association between an observed value of the power of the reference signal R and a corresponding observed value of the power of the observed signal X in each of the frames to be observed in the non-speech segment in a case where both the source of the echo and the background noise exist. In FIG. 4(*b*), relationships of the observed signals X respectively with the reference signals R which are obtained by applying the adaptive coefficients W representing the respective adaptations to be estimated on these observed values are expressed by a plane curve X=W+R. Specifically, it is learned from the figures that the stationary noise components N are simultaneously estimated as a certain value ranging throughout the frames by means of adding the constant term Const. Furthermore, it is learned that exactness in estimating the noise which is similar to that to be obtained in the case of FIG. 3(*b*) where only the source of the echo exists is obtained.

Figure 5:
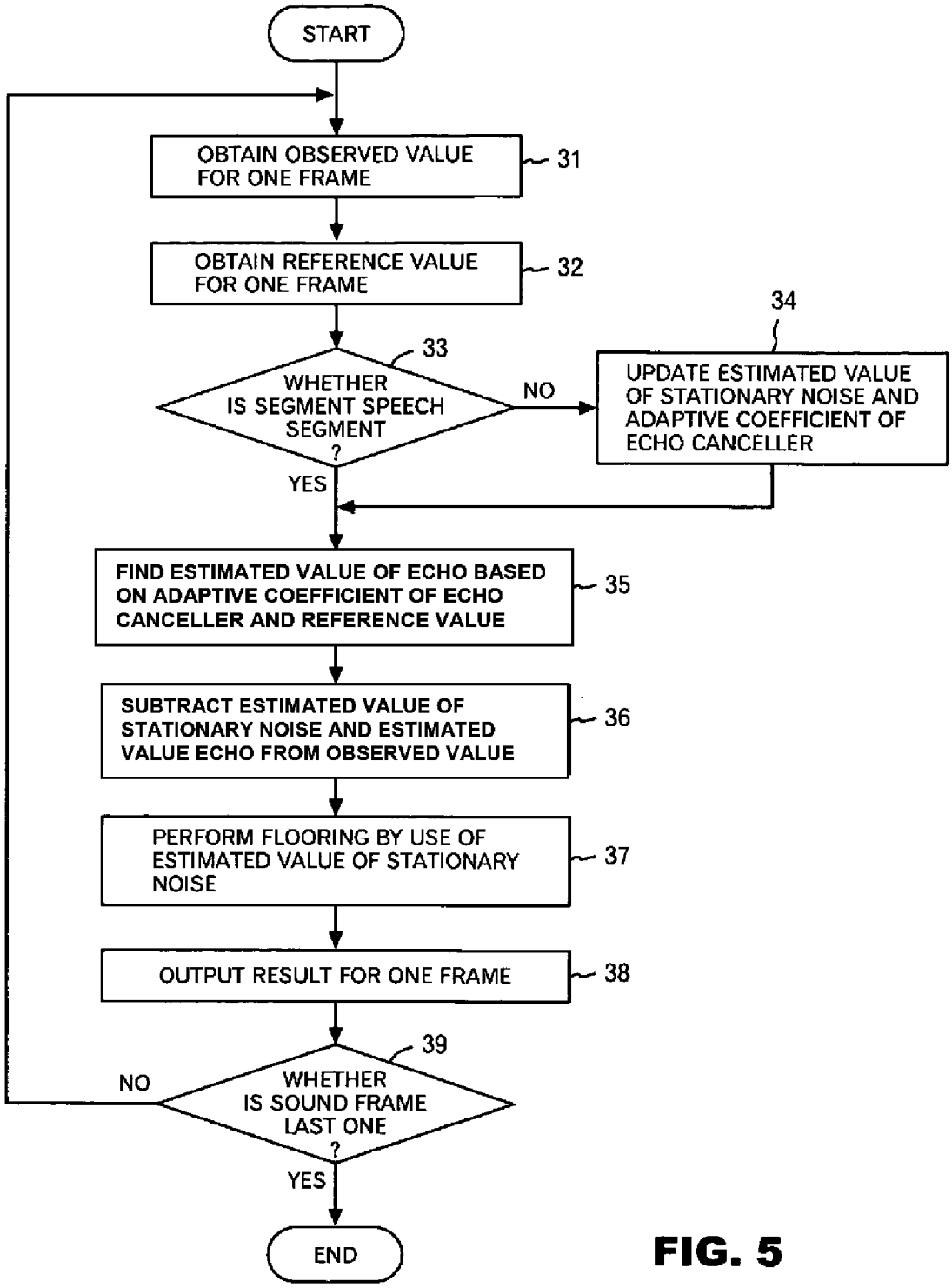
FIG. 5 is a flowchart showing a process to be performed in the noise reduction system shown in FIG. 1.

FIG. 5 is a flowchart showing a process to be performed in the noise reduction system shown in FIG. 1. Once the process begins to be performed, first of all, the system causes the discrete Fourier transform units 4 and 5 to respectively obtain the power spectra Xω(T) and Rω(T) of the observed signal and the reference signal for one frame in steps 31 and 32.

Then, by use of the publicly-known method to be performed on the basis of the power of the observed signal and the like, the system determines, in step 33, whether or not a segment belonged to by the frame for which the power spectra Xω(T) and Rω(T) are obtained this time is a speech segment where a speaker utters speech. In a case where the system determines that the segment belonged to by the frame is not the speech segment, the system proceeds to step 34. In a case where the segment belonged to by the frame is the speech segment, the system proceeds to step 35.

In step 34, the system updates the estimated value of the stationary noise and the adaptive coefficient of the echo canceller. Specifically, the adaptation unit 11 finds the adaptive coefficient Wω(m) by use of Equations (7) to (10), and finds the estimated value Nω of the power spectrum of the stationary noise included in the observed signal. Incidentally, instead of this, the adaptive coefficient Wω(m) and the estimated value Nω of the power spectrum of the stationary noise may be sequentially updated by use of Equations (11a) and (11b). Subsequently, the system proceeds to step 35.

In step 35, the adaptation unit 11 finds the estimated value Qω(T) of the power spectrum of the echo included in the observed signal, by use of Equation (2), on the basis of the adaptive coefficient Wω(m) and the reference signals of the previous M−1 frames. Thereafter, in step 36, the multiplication units 12 and 13 respectively multiply the subtraction weights $\alpha_1$ and $\alpha_2$ to the estimated values Nω and Qω(T) thus figured out. The subtraction unit 14 subtracts the results of the multiplications from the power spectrum Xω(T) of the observed signal in accordance with Equation (12), accordingly obtaining the power spectrum Yω(T) as the consequence of reducing the stationary noise and the echo.

Thence, in step 37, the flooring is performed by use of the estimated value Nω of the stationary noise. Specifically, the multiplication unit 15 multiplies the estimated value Nω of the stationary noise, which has been found by the adaptation unit 11, by the flooring coefficient β. The flooring unit 16 compares the multiplication result β·Nω and the output Yω(T) from the subtraction unit 14 in accordance with Equations (14a) and (14b). The flooring unit 16 outputs Yω(T) as a value representing the power spectrum Zω(T) to be outputted therefrom, if Yω(T)≧β·Nω. The flooring unit 16 outputs β·Nω as a value representing the power spectrum Zω(T) to be outputted therefrom, if Yω(T)<β·Nω. In step 38, the flooring unit 16 outputs the power spectrum Zω(T) for one frame, which the flooring is applied to in this manner.

Subsequently, the system determines, in step 39, whether or not the sound frame to which the process is applied by means of obtaining the power spectra Xω(T) and Rω(T) this time is the last of the sound frames. In a case where the system determines that the sound frame is not the last one, the system returns to step 31. Thus, the system continues performing the process on the following frame. In a case where the system determines that the frame is the last one, the system completes the process shown in FIG. 5.

Through the process show in FIG. 5, the adaptive coefficient Wω(m) is learned in the non-speech segment. On the basis of the result of the learning, furthermore, the power spectrum Zω(T) for the speech recognition process, which the flooring is applied to by means of reducing the stationary noise components and the echo components, can be outputted in the speech segment.

In the case of this embodiment, the adaptive coefficients Wω(M) and Wω(m) (m=0, . . . , M−1) to be used for calculating the estimated values Nω and Qω(T) respectively of the stationary noise components and the non-stationary noise components are designed to be learned at a time as described above. Accordingly, the adaptive coefficients can be learned exactly. This makes it possible to achieve Ladder 2 in the aforementioned development ladders, or noise robustness needed for the speech recognition process to be performed in a vehicle where stationary driving noise and echo coming from the CD/radio exist.

In addition, if a value equal to that representing the subtraction weight which is used for reducing the stationary noise when the acoustic model to be used for a speech recognition process to be performed in Ladder 1 is learned is used as a value representing the subtraction weight $\alpha_1$ to be assigned to the estimated value Nω of the stationary noise, the acoustic model for Ladder 1 can be used, as it is, in the speech recognition process to be performed in Ladder 2. In other words, its consistency with the acoustic model which is used for existing products is high.

Additionally, the noise reduction unit 10 is designed to perform the echo cancellation process, and to reduce the noise components, by use of the spectral subtraction technique. This makes it possible to package the system in the existing speech recognition system without changing the architecture of a speech recognition engine to a large extent.

Furthermore, if a value larger than the subtraction weight $\alpha_1$ is adopted as the subtraction weight $\alpha_2$ to be assigned to the estimated value Qω(T) of the echo, more of the echo components, which are the chief cause of the source error in recognized characters, can be reduced.

Moreover, if the estimated value Qω(T) of the echo in each frame is obtained with additionally reference to the reference signals in the preceding M−1 frames, and concurrently if the adaptive coefficients of the reference signals are defined as M coefficients concerning the reference signals respectively in the M−1 frames, the learning can be performed in a way that reduces the reverberation of the echo inclusively.

Figure 6:
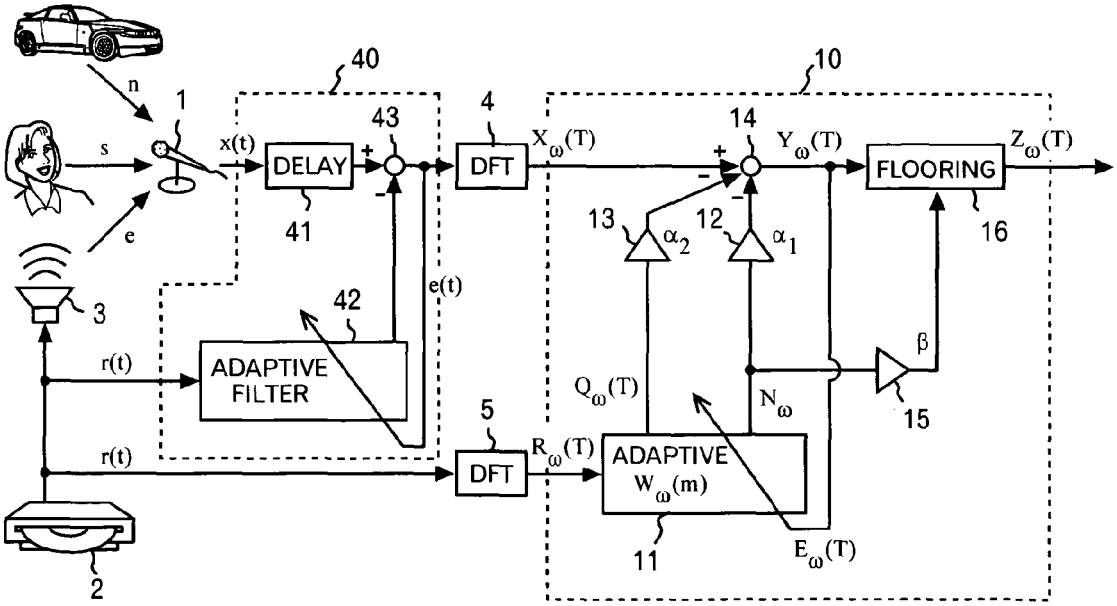
FIG. 6 is a block diagram showing a configuration of a noise reduction system according to another embodiment of the present invention.

FIG. 6 is a block diagram showing a configuration of a noise reduction system according to another embodiment of the present invention. This system is obtained by adding an echo canceller 40 in the time domain to the configuration shown in FIG. 1 in a way that the echo canceller 40 is placed before the discrete Fourier transform unit 4. This system is designed to perform the pre-process by use of the echo canceller 40 as in the case of the conventional example shown in FIG. 15. The echo canceller 40 includes a delay unit 41, an adaptive filter 42 and a subtraction unit 43. The delay section 41 causes a predetermined delay to the observed signal x(t). The adaptive filter 42 outputs the estimated value of the echo components included in the observed signal x(t) on the basis of the reference signal r(t). The subtraction unit 43 subtracts the estimated value of the echo components from the observed signal x(t). An output from the subtraction unit 43 is inputted into the discrete Fourier transform unit 4. In addition, the adaptive filter 42 makes reference the output from the subtraction unit 43 as an error signal e(t), and thus adjusts filter characteristics of its own. In the case of this noise reduction system, the performance of the noise reduction can be enhanced further in return for increase in the load on the CPU.

In the case of Example 1, first of all, the microphone 1 shown in FIG. 1 is placed at a position of the visor in a vehicle. Speech uttered by 12 male speakers and 12 female speakers, each of whom speaks 13 sentences as consecutive numbers and 13 sentences as commands, was recorded in each of actual environments respectively in vehicles, one of which was idling (at a speed of 0 km), another of which ran in an urban district (at a speed of 50 km), the other of which ran at a high speed (at a speed of 100 km). The total number of the recorded sentences in data concerning this recorded speech was 936 sentences as consecutive numbers and 936 sentences as commands. Since the speech was recorded in each of the actual environments, the noise included stationary driving sound, more or less sound from other vehicles passing by, environmental sound, noise from the air conditioner, and the like. For this reason, even when the speed was 0 km, the speech was influenced by the noise.

In addition, when the vehicle was at a stop, the CD/radio 2 was operated, and accordingly music was outputted from the speaker 3. Thus, an observed signal from the microphone 1 and a reference signal from the CD/radio were recorded at a time. Then, the observed signal thus recorded (hereinafter referred to as "data concerning recorded music") was overlapped over data concerning the recorded speech at an adequate level.

Thereby, an experimental observed signal x(t) was generated in a case where the speed was 0 km, in another case where the speed was 50 km, and in the other case where the speed was 100 km.

Then, a noise reduction was applied to the recorded reference signal r(t) and the generated experimental observed signal x(t) by use of the system shown in FIG. 1, and thus a speech recognition was performed. Incidentally, a speaker-independent model to be generated by over-lapping various stationary cruising noises and concurrently by applying a spectral subtraction was used as the acoustic model. A connected digits task (hereinafter referred to as a "digit task") of reading digits, such as "1," "3," "9," "2" and "4," was performed as a task of speech recognition. In addition, a command task was performed on 368 words related to "change in route," "access to addresses" and the like. Furthermore, in order to make a fair comparison, a silence detector was not used, and all of the segments in a file to be created each time speech was uttered were objects to be recognized, when the speech recognition was performed. As well, a value representing the number M of frames in the reference signal to be used for calculating the estimated value Qω(T) of the echo was 5, and values representing the subtraction weights $\alpha_1$ and $\alpha_2$ were 1.0 and 2.0 respectively.

It should be noted that the digit task is sensitive to the insertion error in recognized characters in the non-speech segment and that the digit task is accordingly suitable to observe an amount of reducing the echo, or the noise made from the musical sound in this case. This is because the number of digits is not limited in the digit task. On the other hand, the command task is free from the source error in recognized characters. This is because the grammar in the command task consists of one sentence and one word. For this reason, one may think that the command task is suitable to observe a degree of speech distortion in a speech segment.

The noise reduction method of the system shown in FIG. 1 and a diagram showing the noise reduction method thereof are shown in columns representing Example 1 in Table 2 shown in FIG. 7. In Table 2, "SS" denotes the spectral subtraction, "NR" denotes the noise reduction, and "EC" denotes the echo canceller. In the case of this method, adaptive coefficients respectively for calculating an estimated value N" of stationary noise and an estimated value WR of echo are learned on the basis of an observed signal X and a reference signal R. The estimated values N" and WR, which are obtained after the learning, are subtracted from the observed signal. Thereby, an output Y is designed to be obtained. In other words, the estimated value N" of the stationary noise is designed to be found simultaneously in the process of learning the adaptive coefficient.

Word error rate (%) concerning the experimental observed signals to be observed respectively when the vehicle speeds were 0 km, 50 km and 100 km, as well as an average of the rates, are shown, as a result of performing the speech recognition by means of the digit task, in columns representing Example 1 in Table 3 shown in FIG. 8. In addition, word error rate (%) in words concerning the experimental observed signals, as well as an average of the rates, are shown, as a result of performing the speech recognition by means of the command task, in columns representing Example 1 in Table 4 shown in FIG. 9.

As Example 2, the speech recognition was performed under the same conditions as the speech recognition as Example 1 was performed, except for by use of the system shown in FIG. 6. The noise reduction method of the system and a block diagram showing the noise reduction method thereof are shown in columns representing Example 2 in Table 2. This method is obtained by adding the echo canceller in the time domain, as the pre-processor, to the method of Example 1. In addition, results of performing the speech recognition respectively by means of the tasks are shown in columns representing Example 2 in Tables 3 and 4.

As Comparative Example 1, the speech recognition was performed, by use of the noise reduction method shown in columns representing Comparative Example 1 in Table 2, under the same conditions as the speech recognition as Example 1 was performed, except that the data concerning the recorded speech on which no recorded musical sound was overlapped was used, instead of the experimental observed signals, for the speech recognition. Results of performing the speech recognition by means of the respective tasks are shown in columns representing Comparative Example 1 in Tables 3 and 4. In the case of this noise reduction method, only the spectral subtraction was applied as measures against the stationary noise and the echo. Even this method brought about sufficiently high performance of the speech recognition in an environment where only stationary noise exists.

As Comparative Examples 2 to 5, the speech recognitions were performed under the same conditions as the speech recognition as Example 1 was performed, except for by use of the respective noise reduction methods shown in columns representing Comparative Examples 2 to 5 in Table 2. Results of performing the speech recognitions are shown in columns representing Comparative Examples 2 to 5 in Tables 3 and 4.

In the case of the noise reduction method of Comparative Example 2, only the conventional mode of the spectral subtraction was performed, but no echo cancellation was performed, as shown in the columns representing Comparative Example 2 in Table 2. In this case, the performance of the speech recognition was relatively low in comparison with Comparative Examples 3 to 5 which used the same experimental observed signals as Comparative Example 2 used, as shown in Tables 3 and 4. This is because no echo cancellation was performed.

Figure 13:
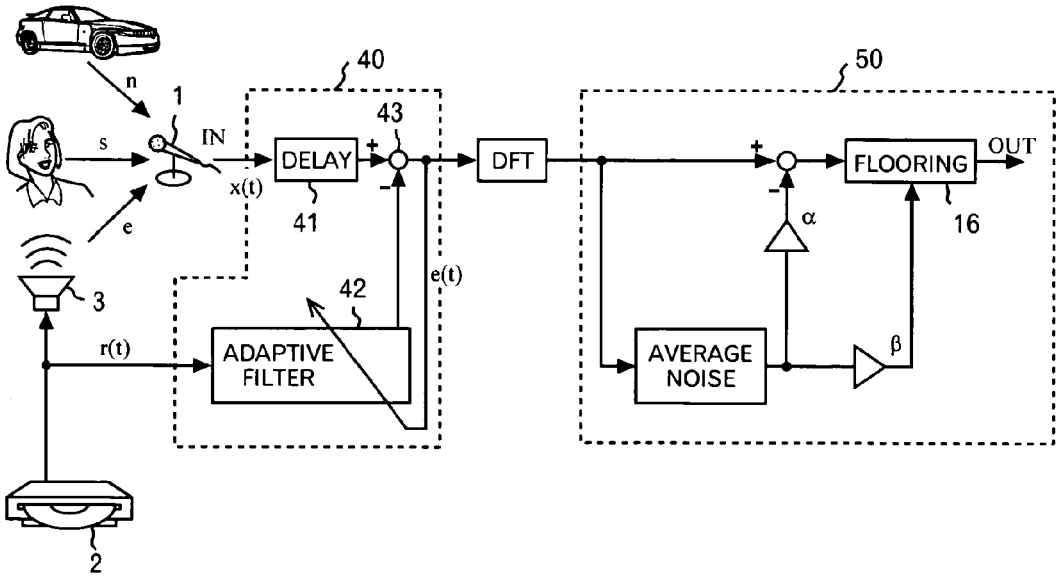
FIG. 13 is a block diagram showing a configuration of another conventional noise reduction device which includes an echo canceller in its front stage and a noise reduction unit in its rear stage.

In the case of this noise reduction method of Comparative Example 3, the echo cancellation was designed to be performed in the front stage, and the spectral subtraction was designed to be performed in the rear stage, as measures against the stationary noise and the echo, as shown in columns representing Comparative Example 3 in Table 2. The echo cancellation in the front stage was performed by use of a normalized least-mean-square (N-LMS) algorithm with a tap number of 2048. This method was equivalent to the conventional technique shown in FIG. 13. Since the echo cancellation was performed, the exactness in the speech recognition was considerably enhanced in comparison with Comparative Example 2, as shown in FIGS. 3 and 4.

In the case of this noise reduction method of Comparative Example 4, the stationary noise was designed to be reduced in the front stage by means of performing the spectral subtraction, and the echo was designed to be reduced in the rear stage by an echo canceller in the spectral subtraction mode, as shown in the corresponding columns in Table 2. This method was equivalent to the conventional technique shown in FIG. 14. However, in order to enable a fair comparison to be made, a measures against the reverberation, which was the same as that applied to the methods of Examples 1, was applied to the method of Comparative Example 4. The method of Comparative Example 4 exhibited higher performance than the method of Comparative Example 2 did, as shown in Tables 3 and 4. However, the method of Comparative Example 4 was inferior to the method of Comparative Example 3 in performance. This is because there was large error in estimating the stationary noise.

The chief difference between Comparative Example 4 and Example 1 is that the stationary noise components were simultaneously figured out in the process of adapting the echo canceller in the case of Comparative Example. The method of Example 1 was superior to the methods of Comparative Examples 3 and 4 in performance.

The method of Comparative Example 5 was obtained by introducing the echo canceller in the time domain, as the pre-processor, to the front stage of the method of Comparative Example 4. This method was equivalent to the conventional technique shown in FIG. 15. Incidentally, in order to enable a more fair comparison to be made, only the measures against the reverberation which was taken in the methods of Examples 1 and 2 was applied to the method of Comparative Example 5. In the case of Comparative Example 5, effects brought about by the pre-processor improved the performance to a large extent in comparison with Comparative Example 4, as shown in Tables 3 and 4. The method of Comparative Example 5 did not exceed the method of Example 1 in performance, although the method of Example 1 included no pre-processor.

The reason why the results of Examples 1 and 2 were superior to the results of Comparative Examples 3 and 4 can be considered as follows. Specifically, in the case of the method of Comparative Example 3, the observed signal to be inputted into the echo canceller in the front stage included the stationary noise components as they were, none of which components were reduced from the observed signal. This inclusion decreased the performance of the echo canceller in a high-noise environment. Furthermore, in the case of the method of Comparative Example 4, an averaged power N' which was subtracted from the observed signal X in the front stage included influence of the echo. This made it impossible to reduce the stationary noise exactly.

On the contrary, in the case of Example 1, the estimated value N" of the stationary noise components and the adaptive coefficient W in the echo canceller were designed to be learned at a time. On the basis of the result, the noise reduction was designed to be performed. This made it possible to reduce both the stationary noise and the echo adequately. Moreover, in the case of Example 2, the echo canceller in the time domain was introduced as the pre-processor. This made it possible to further enhance the performance, as shown in Tables 3 and 4.

Figure 10:
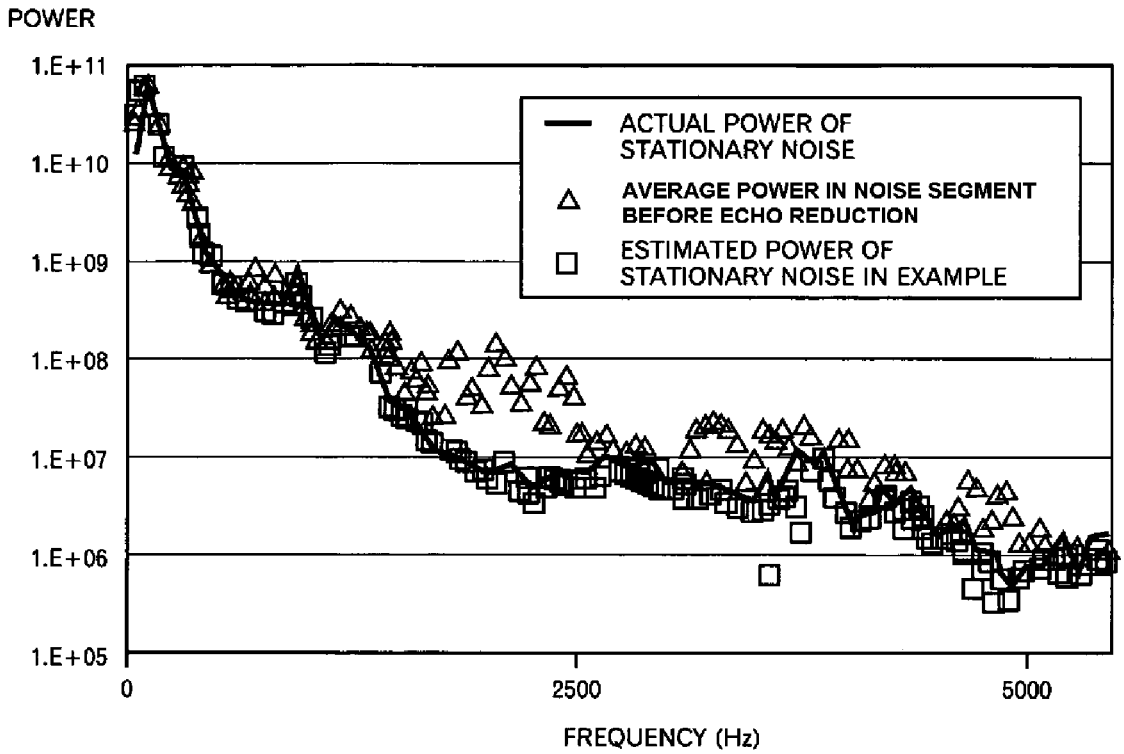
FIG. 10 is a graph showing how well an estimated value of power of stationary noise components which are learned by use of a method of Example 1 agrees with true power of the stationary noise.
Figure 12:
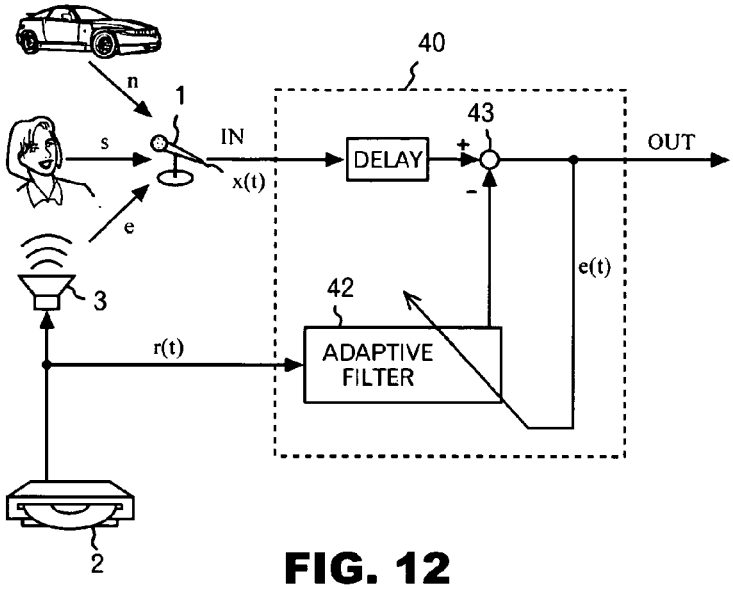
FIG. 12 is a block diagram showing a configuration of a conventional noise reduction device using only an ordinary echo canceller.

FIG. 10 is a graph showing how well an estimated value of power of the stationary noise components which were learned by use of the method of Example 1 agreed with true power of the stationary noise even in a case where the learning were performed in an environment where echo always existed. The curve in FIG. 10 indicates true power of stationary noise in a speech, which true power was based on data concerning recorded speech on which no data concerning recorded musical sound was superimposed. Each triangle (A) indicates an estimated value of the power of the stationary noise which was learned by use of the method of Example 1 on the basis of parts of the experimental observed signal, which parts corresponded to the speech. Each square (□) indicates an averaged power concerning a noise segment (non-speech segment) in the same parts of the experimental observed signal, from which parts no echo was reduced. It can be learned that the estimated value of the stationary noise components which were learned by use of the method of Example 1 were well approximate to the true stationary noise components.

In Table 3 (FIG. 8), an average of word error rate which was caused by the method of Comparative Example 3 was 2.8[%], whereas an average of word error rate which was caused by the method of Comparative Example 2 was 1.6[%]. For this reason, in the case of Example 2, the word error rate were reduced by 43[%] in comparison with Comparative Example 3 with regard to the digit task. As well, in Table 4 (FIG. 9), an average of word error rate which was caused by the method of Comparative Example 3 was 4.6[%], whereas an average of word error rate which was caused by the method of Comparative Example 2 was 2.6[%]. For this reason, in the case of Example 2, the word error rate was reduced by 43[%] in comparison with Comparative Example 3 with regard to the command task. The reduction of the word error rate by more than 40[%] meant a remarkable improvement in the field of the speech recognition.

It should be noted that the present invention is not limited to the aforementioned embodiments, and that the present invention can be carried out by modifying the present invention whenever deemed necessary. For example, in the case of the aforementioned embodiments, the noise reduction process is performed by means of subtracting power spectrum. Instead, however, the noise reduction process may be performed by means of subtracting magnitude. In general, the noise reduction process is implemented by means of subtracting both the power and the magnitude.

Moreover, in the case of the aforementioned embodiments, the spectral subtraction technique is used in order to reduce stationary noise (background noise). Instead, however, another method of reducing the spectrum of the background noise, such as the Wiener filter, may be used to this end.

Furthermore, the present invention has been described giving the example of the echo and the reference signal which are in the form of a monophonic signal. The present invention is not limited to this. The present invention can deal with the echo and the reference signal which are in the form of a stereo signal. Specifically, as described in the section of the prior art, the power spectrum of the reference signal may be defined as a weighted average of its right and left reference signals. In addition, the stereo echo canceller technique may be applied to the pre-process for the echo canceller in the time domain.

Additionally, in the case of the aforementioned embodiments, the sound signal outputted from the CD/radio 2 is used as the reference signal. Instead, however, a sound signal outputted from the car navigation system may be used as the reference signal. This makes it possible to realize barge-in which accepts an interruption of the system prompt with the user's speech through performing the speech recognition while the system is in the process of giving a message to the driver via voice.

As well, in the case of the aforementioned embodiments, the noise reduction is designed to be performed for the purpose of performing the speech recognition in the vehicle compartment. However, the present invention is not limited to this. The present invention can be applied for the purpose of performing the speech recognition in any other environment. For example, the speech recognition may be designed to be capable of being performed by use of a portable personal computer (hereinafter referred to as a "note PC") while a speech file in the MP3 format, or musical sound of a CD or the like is being played back, by the following means. The speech recognition system for performing the noise reduction in accordance with the present invention is configured by use of the note PC. Thus, a speech signal outputted from the note PC is used as the reference signal in the system.

Commands may be designed to be capable of being inputted into a robot by use of speech while canceling internal noise, including noise from the servo motor, which becomes conspicuous during operations of the robot, by the following means. A speech recognition system for performing the noise reduction in accordance with the present invention is configured in the robot. A microphone with which to obtain the reference signal is set in the body of the robot. A microphone with which to receive commands, which microphone is directed outward from the body, is set in the body. Moreover, commands, including a channel change and preset timer record, may be designed to be capable of being given to a home TV set by use of speech while TV is being watched, by the following means. A speech recognition system for performing the noise reduction in accordance with the present invention is configured in the TV set. Sound outputted from the TV set is used as the reference signal.

In addition, the present invention has been described using the case of the application of the present invention to the speech recognition. However, the present invention is not limited to this. The present invention can be applied to various purposes for which stationary noise and echo need to be reduced. For example, in the case of calling with a hands-free telephone, a speech signal transmitted from a caller on the other end of the line is converted to speech by use of the speaker. This speech is inputted, as echo, through the microphone with which the user of the telephone inputs his/her speech. With this taken into consideration, if the present invention is applied to the telephone so that the speech signal transmitted from the caller on the other end of the line is used as the reference signal, this makes it possible to reduce the echo components from the input signal, thus enabling quality of the call to be improved.

In the case of the present invention, each of adaptive coefficients to be used for calculating estimated values respectively of stationary noise components and non-stationary noise components is designed to be learned on the basis of an observed signal and a reference signal in the frequency domain at a time. This enables each of the adaptive coefficients to be learned more exactly even in a segment where both of the stationary noise components and the non-stationary noise components are present, and thus making it possible to more exactly figure out the estimated values respectively of the stationary noise components and the non-stationary noise components. In this respect, a noise reduction process can be applied to both the stationary noise components and the non-stationary noise components by use of the spectral subtraction technique. This does not largely change a framework of the spectral subtraction which is prevailingly in use in the current speech recognition practice.

Accordingly, if a first subtraction coefficient taking on a value equivalent to that of a subtraction coefficient to be used for reducing stationary noise by use of the spectral subtraction technique is adopted, when the acoustic model to be used for speech recognition is used as described before, this makes it possible to perform a noise reduction process suitable for the acoustic model. For this reason, the existing acoustic model can be utilized effectively.

Furthermore, in this case, if the second subtraction coefficient which takes on a value larger than that taken on by the first subtraction coefficient is adopted as described above, an over-subtraction technique can be introduced. In other words, if only the second subtraction coefficient concerning the echo components as the non-stationary noise components is set at a value larger than that taken on by a subtraction coefficient which is supposed in the acoustic model, more of the echo components, which are the chief cause of the source error in recognized characters, can be reduced while maintaining interchangeability between the noise reduction technique and the acoustic model when stationary noise is intended to be reduced.

As described above, moreover, if estimated values of non-stationary noise components in each of predetermined frames are acquired on the basis of reference signals respectively of a plurality of predetermined frames preceding the frame, and concurrently if adaptive coefficients concerning the respective reference signals are defined as a plurality of coefficients concerning the reference signals respectively of the plurality of frames, the learning can be performed in order to reduce the echo reverberation, which is the non-stationary noise components, inclusively.

Although the preferred embodiments of the present invention have been described in detail, it should be understood that various changes, substitutions and alternatives can be made therein without departing from the spirit and scope of the invention as defined by the appended claims. Thus, the present invention can be realized in hardware, software, or a combination of hardware and software. It may be implemented as a method having steps to implement one or more functions of the invention, and/or it may be implemented as an apparatus having components and/or means to implement one or more steps of a method of the invention described above and/or known to those skilled in the art. A visualization tool according to the present invention can be realized in a centralized fashion in one computer system, or in a distributed fashion where different elements are spread across several interconnected computer systems. Any kind of computer system—or other apparatus adapted for carrying out the methods and/or functions described herein—is suitable. A typical combination of hardware and software could be a general purpose computer system with a computer program that, when being loaded and executed, controls—the computer system such that it carries out the methods described herein. The present invention can also be embedded in a computer program product, which comprises all the features enabling the implementation of the methods described herein, and which—when loaded in a computer system—is able to carry out these methods.

Computer program means or computer program in the present context include any expression, in any language, code or notation, of a set of instructions intended to cause a system having an information processing capability to perform a particular function either directly or after conversion to another language, code or notation, and/or after reproduction in a different material form.

Thus the invention includes an article of manufacture which comprises a computer usable medium having computer readable program code means embodied therein for causing one or more functions described above. The computer readable program code means in the article of manufacture comprises computer readable program code means for causing a computer to effect the steps of a method of this invention. Similarly, the present invention may be implemented as a computer program product comprising a computer usable medium having computer readable program code means embodied therein for causing a function described above. The computer readable program code means in the computer program product comprising computer readable program code means for causing a computer to affect one or more functions of this invention. Furthermore, the present invention may be implemented as a program storage device readable by machine, tangibly embodying a program of instructions executable by the machine to perform method steps for causing one or more functions of this invention. Methods of this invention may be implemented by an apparatus which provides the functions carrying out the steps of the methods. Apparatus and/or systems of this invention may be implemented by a method that includes steps to produce the functions of the apparatus and/or systems.

It is noted that the foregoing has outlined some of the more pertinent objects and embodiments of the present invention. This invention may be used for many applications. Thus, although the description is made for particular arrangements and methods, the intent and concept of the invention is suitable and applicable to other arrangements and applications. It will be clear to those skilled in the art that modifications to the disclosed embodiments can be effected without departing from the spirit and scope of the invention. The described embodiments ought to be construed to be merely illustrative of some of the more prominent features and applications of the invention. Other beneficial results can be realized by applying the disclosed invention in a different manner or modifying the invention in ways known to those familiar with the art.

What is claimed, is:

1. A noise reduction device comprising:

a microphone for converting surrounding sounds to a first observed signal in a frequency domain into a form of an electric signal, wherein the sounds comprise stationary and non-stationary noise components;

a discrete transform unit for receiving as a first reference signal an output signal transmitted from an input source to an output source and converting said first reference signal to a second reference signal in a form of a power spectrum in each of a plurality of predetermined time frames;

a central processor unit configured to:

calculate a predetermined constant by use of an adaptive coefficient for the predetermined constant, calculating calculate a predetermined second reference signal in the frequency domain by use of an adaptive coefficient for the reference signal, and thereby obtaining estimated values respectively of stationary noise components included in a predetermined observed signal in the frequency domain and non-stationary noise components corresponding to the reference signal;

the central processor unit configured to perform a noise reduction process on the first observed signal on the basis of each of the estimated values, and updating each of the adaptive coefficients on the basis of a result of the noise reduction process; and a central processor unit configured to repeat the obtaining of the estimated values and the updating of the adaptive coefficients, and thereby learning each of the adaptive coefficients;

the central processor unit configured to convert the first observed signal to a second observed signal in a form of a power spectrum in each of a plurality of predetermined time frames;

wherein the adaptive coefficient to be used for calculating estimated values respectively of the stationary noise components and the non-stationary noise components is designed to be learned on a basis of the second observed signal and the second reference signal in the frequency domain at a same time.

2. The noise reduction device according to claim 1, including:

means for converting a sound wave to an electric signal;

means for converting the electric signal to a signal in the frequency domain, and thus obtaining the observed signal;

means for converting a signal corresponding to sound emitted by a source of non-stationary noise which is a cause of the non-stationary noise components to a signal in the frequency domain, and thus obtaining the reference signal.

3. The noise reduction device according to claim 2, wherein the signal corresponding to the sound emitted from the source of non-stationary noise is obtained by electrically converting a sound wave emitted from the source of non-stationary noise.

4. The noise reduction device according to claim 2, further comprising means for applying echo cancellation in the time domain to the electric signal on the basis of the reference signal, which has not yet been converted to a signal in the frequency domain, before the electric signal is converted to the signal in the frequency domain.

5. The noise reduction device according to claim 1, wherein the observed signal and the reference signal are obtained by converting a signal in the time domain to a signal in the frequency domain in each of predetermined time frames, wherein an estimated value of the non-stationary noise components in each of predetermined frames is obtained on the basis of the reference signals in a plurality of predetermined frames preceding the frame; and wherein the adaptive coefficients of the reference signal are a plurality of coefficients concerning the reference signals respectively of the plurality of frames.

6. The noise reduction device according to claim 5, wherein the noise reduction process is a process for subtracting the estimated values respectively of the stationary noise components and the non-stationary noise components from the observed signal, wherein the learning is performed by updating the adaptive coefficient in a way that minimizes a mean square value of a difference between the observed signal and a sum of the estimated values respectively of the stationary noise components and the non-stationary noise components in each of the predetermined frames.

7. The noise reduction device according to claim 1, further comprising noise reduction means for obtaining the estimated values respectively of the stationary noise components and the non-stationary noise components, by use of each of adaptive coefficients obtained by the learning in a noise segment where the observed signal does not include the non-stationary noise components, and on the basis of the reference signal in a non-noise segment where the observed signal includes the non-stationary noise components, accordingly performing the noise reduction process on the observed signal on the basis of each of the estimated values.

8. The noise reduction device according to claim 7, wherein the non-stationary noise components are based on speech uttered by a speaker, and wherein an output from the noise reduction means is used for performing speech recognition on the speech uttered by the speaker.

9. The noise reduction device according to claim 8, wherein the noise reduction process is a process for subtracting the estimated values respectively of the stationary noise components and the non-stationary noise components from the observed signal, wherein the noise reduction means includes means for multiplying the estimated value of the stationary noise components by a first subtraction coefficient before the subtraction process, and wherein a value taken of the first subtraction coefficient is a value equivalent to that of a subtraction coefficient to be used for reducing the stationary noise by means of performing spectral subtraction when an acoustic model to be used for the speech recognition is learned.

10. The noise reduction device according to claim 9, wherein the noise reduction means includes means for multiplying the estimated value of the non-stationary noise components by a second subtraction coefficient before the subtraction process, and wherein a value of the second subtraction coefficient is a value larger than that of the first subtraction coefficient.

11. A computer program product comprising non-transitory computer usable medium having computer readable program code means embodied therein for causing functions of a noise reduction device, the computer readable program code means in said computer program product comprising computer readable program code a procedure for causing a computer to effect the functions of claim 1.

12. An information storage device comprising a noise reduction program that when executed by a central processing unit causes a computer to execute:

converting surrounding sounds from a first observed signal in a frequency domain into a form of an electric signal, wherein the sounds comprise stationary and non-stationary noise components;

receiving as a first reference signal an output signal transmitted from an input source to an output source and converting said first reference signal to a second reference signal in a form of a power spectrum in each of multiple predetermined time frames;

a procedure for calculating a predetermined constant by use of an adaptive coefficient for the constant, calculating a predetermined first reference signal in the frequency domain by use of an adaptive coefficient for the reference signal, and thereby obtaining estimated values respectively of stationary noise components included in a predetermined observed signal in the frequency domain and non-stationary noise components corresponding to the first reference signal;

a procedure for performing a noise reduction process on the first observed signal on the basis of each of the estimated values, and updating each of the adaptive coefficients on the basis of a result of the noise reduction process;

a procedure for converting the first observed signal to a second observed signal in a form of a power spectrum in each of a plurality of predetermined time frames; and an adaptive procedure for repeating the obtaining of the estimated values and the updating of the adaptive coefficients, and thereby learning each of the adaptive coefficients;

wherein the adaptive coefficient to be used for calculating estimated values respectively of the stationary noise components and the non-stationary noise components is designed to be learned on a basis of the second observed signal and the second reference signal in the frequency domain at a same time.

13. The noise reduction program according to claim 12, further comprising:

a procedure for converting a sound wave to an electric signal; a procedure for converting the electric signal to a signal in the frequency domain, and thus obtaining the observed signal;

a procedure for converting a signal corresponding to sound emitted by a source of non-stationary noise which is a cause of the non-stationary noise components to a signal in the frequency domain, and thus obtaining the reference signal.

14. The noise reduction program according to claim 12, wherein the observed signal and the reference signal are obtained by converting a signal in the time domain to a signal in the frequency domain in each of predetermined time frames, wherein an estimated value of the non-stationary noise components in each of predetermined frames is obtained on the basis of the reference signals in a plurality of predetermined frames preceding the frame; and wherein the adaptive coefficients of the reference signal are a plurality of coefficients concerning the reference signals respectively of the plurality of frames.

15. The noise reduction program according to claim 12, further comprising noise reduction a procedure for obtaining the estimated values respectively of the stationary noise components and the non-stationary noise components, by use of each of adaptive coefficients obtained by the learning in a noise segment where the observed signal does not include the non-stationary noise components, and on the basis of the reference signal in a non-noise segment where the observed signal includes the non-stationary noise components, accordingly performing the noise reduction process on the observed signal on the basis of each of the estimated values;

wherein the non-stationary noise components are based on speech uttered by a speaker, and wherein an output from the noise reduction means is used for performing speech recognition on the speech uttered by the speaker;

wherein the noise reduction process is a process for subtracting the estimated values respectively of the stationary noise components and the non-stationary noise components from the observed signal, wherein the noise reduction means includes a procedure for multiplying the estimated value of the stationary noise components by a first subtraction coefficient before the subtraction process, and wherein a value taken of the first subtraction coefficient is a value equivalent to that of a subtraction coefficient to be used for reducing the stationary noise by means of performing spectral subtraction when an acoustic model to be used for the speech recognition is learned;

wherein the noise reduction means includes a procedure for multiplying the estimated value of the non-stationary noise components by a second subtraction coefficient before the subtraction process, and wherein a value of the second subtraction coefficient is a value larger than that of the first subtraction coefficient.

16. A noise reduction method comprising the steps of:

using a microphone for converting surrounding sounds to a first observed signal in a frequency domain into a form of an electric signal, wherein the sounds comprise stationary and non-stationary noise components;

using a discrete transform unit for receiving as a first reference signal an output signal transmitted from an input source to an output source and converting said first reference signal to a second reference signal in a form of a power spectrum in each of the predetermined time frames;

obtaining a reference signal which is a consequence of converting a signal corresponding to sound emitted from a source of non-stationary noise to a signal in the frequency domain;

calculating a predetermined constant by use of an adaptive coefficient for the constant, calculating a predetermined reference signal in the frequency domain by use of an adaptive coefficient for the reference signal, and thereby obtaining estimated values respectively of stationary noise components included in the observed signal and non-stationary noise components based on a sound wave from the source of non-stationary noise;

performing a noise reduction process on the first observed signal on the basis of each of the estimated values, and updating each of the adaptive coefficients on the basis of a result of the noise reduction process repeating the obtaining of the estimated values and the updating of the adaptive coefficients, and thereby learning each of the adaptive coefficients; and converting the first observed signal to a second observed signal in a form of a power spectrum in each of a plurality of predetermined time frames;

wherein the adaptive coefficient to be used for calculating estimated values respectively of the stationary noise components and the non-stationary noise components is designed to be learned on a basis of the second observed signal and the second reference signal in the frequency domain at a same time.

17. The noise reduction device method to claim 16, including:

converting a sound wave to an electric signal;

converting the electric signal to a signal in the frequency domain, and thus obtaining the observed signal; and converting a signal corresponding to sound emitted by a source of non-stationary noise which is a cause of the non-stationary noise components to a signal in the frequency domain, and thus obtaining the reference signal.

18. The noise reduction method according to claim 17, wherein the signal corresponding to the sound emitted from the source of non-stationary noise is obtained by electrically converting a sound wave emitted from the source of non-stationary noise;

further comprising obtaining the estimated values respectively of the stationary noise components and the non-stationary noise components, by use of each of adaptive coefficients obtained by the learning in a noise segment where the observed signal does not include the non-stationary noise components, and on the basis of the reference signal in a non-noise segment where the observed signal includes the non-stationary noise components, accordingly performing the noise reduction process on the observed signal on the basis of each of the estimated values;

wherein the non-stationary noise components are based on speech uttered by a speaker;

wherein an output from the noise reduction means is used for performing speech recognition on the speech uttered by the speaker;

wherein the noise reduction process is a process for subtracting the estimated values respectively of the stationary noise components and the non-stationary noise components from the observed signal, wherein the noise reduction means includes means for multiplying the estimated value of the stationary noise components by a first subtraction coefficient before the subtraction process, and wherein a value taken of the first subtraction coefficient is a value equivalent to that of a subtraction coefficient to be used for reducing the stationary noise by means of performing spectral subtraction when an acoustic model to be used for the speech recognition is learned.

wherein the noise reduction means includes means for multiplying the estimated value of the non-stationary noise components by a second subtraction coefficient before the subtraction process, and wherein a value of the second subtraction coefficient is a value larger than that of the first subtraction coefficient.

19. The noise reduction method according to claim 17, further comprising means for applying echo cancellation in the time domain to the electric signal on the basis of the reference signal, which has not yet been converted to a signal in the frequency domain, before the electric signal is converted to the signal in the frequency domain;

wherein the noise reduction process is a process for subtracting the estimated values respectively of the stationary noise components and the non-stationary noise components from the observed signal, wherein the learning is performed by updating the adaptive coefficient in a way that minimizes a mean square value of a difference between the observed signal and a sum of the estimated values respectively of the stationary noise components and the non-stationary noise components in each of the predetermined frames.

20. An article of manufacture comprising non-transitory computer usable medium having computer readable program code means embodied therein for causing noise reduction, the computer readable program code means in said article of manufacture comprising computer readable program code means for causing a computer to effect the steps of claim 16.

* * * * *